US008491753B2

(12) United States Patent
Wong Shing et al.

(10) Patent No.: US 8,491,753 B2
(45) Date of Patent: Jul. 23, 2013

(54) COMPOSITION AND METHOD FOR IMPROVING RETENTION AND DRAINAGE IN PAPERMAKING PROCESSES BY ACTIVATING MICROPARTICLES WITH A PROMOTER-FLOCCULANT SYSTEM

(75) Inventors: Jane B. Wong Shing, Aurora, IL (US); Javier S. Cardoso, Tannay (CH)

(73) Assignee: Nalco Company, Naperville, IL (US)

( * ) Notice: Subject to any disclaimer, the term of this patent is extended or adjusted under 35 U.S.C. 154(b) by 480 days.

(21) Appl. No.: 11/782,018

(22) Filed: Jul. 24, 2007

(65) Prior Publication Data

US 2009/0025891 A1 Jan. 29, 2009
US 2012/0216970 A9 Aug. 30, 2012

Related U.S. Application Data

(63) Continuation-in-part of application No. 10/966,312, filed on Oct. 15, 2004, now abandoned.

(51) Int. Cl.
*D21C 5/02* (2006.01)

(52) U.S. Cl.
USPC ..... 162/5; 162/164.1; 162/164.5; 428/362; 428/363

(58) Field of Classification Search
USPC ..... 162/164.1, 164.5, 5; 428/362, 363
See application file for complete search history.

(56) References Cited

U.S. PATENT DOCUMENTS

| | | | | |
|---|---|---|---|---|
| 5,532,308 | A | 7/1996 | Schuster et al. | |
| 5,876,563 | A * | 3/1999 | Greenwood | 162/175 |
| 6,071,379 | A | 6/2000 | Wong Shing et al. | |
| 6,486,216 | B1 | 11/2002 | Keiser et al. | |
| 6,592,718 | B1 * | 7/2003 | Wong Shing et al. | 162/164.1 |
| 6,616,806 | B2 * | 9/2003 | I Chen | 162/168.1 |
| 2003/0164336 | A1 | 9/2003 | Weir et al. | |
| 2006/0084772 | A1 * | 4/2006 | Wong Shing et al. | 526/217 |
| 2006/0142432 | A1 * | 6/2006 | Harrington et al. | 524/13 |

OTHER PUBLICATIONS

Gratton, Richard; Potential Incompatibilities in Application of Chemical Additives in Papermaking. What May Go Wrong . . . ?, Dec. 2003.

* cited by examiner

*Primary Examiner* — Jacob Thomas Minskey
(74) *Attorney, Agent, or Firm* — Benjamin E. Carlsen; Andrew B. Sorensen

(57) ABSTRACT

A composition and method for improving retention and drainage in a papermaking process is disclosed. An unexpected synergistic effect has been observed when certain amounts of a promoter are used in conjunction with a microparticle. Optionally, a flocculent is also used to further improve the observed synergism. The microparticle includes an inorganic anionic or cationic siliceous material. The promoter includes a modified diallyl-N,N-disubstituted ammonium halide polymer. The flocculant includes one or more high molecular weight, water-soluble cationic, anionic, nonionic, zwitterionic, or amphoteric polymers.

19 Claims, No Drawings

COMPOSITION AND METHOD FOR IMPROVING RETENTION AND DRAINAGE IN PAPERMAKING PROCESSES BY ACTIVATING MICROPARTICLES WITH A PROMOTER-FLOCCULANT SYSTEM

CROSS-REFERENCE TO RELATED APPLICATIONS

This Application is a continuation in part of U.S. patent application Ser. No. 10/966,312 filed on Oct. 15, 2004 now abandoned.

TECHNICAL FIELD

This invention relates generally to a method of improving retention and drainage performance in a papermaking process. More specifically, the invention relates to a promoter added with or without a flocculant to activate microparticles in a papermaking process. The invention has particular relevance to adding structurally modified diallyl-N,N-disubstituted ammonium halide polymers alone or in combination with one or more high molecular weight, water soluble cationic, anionic, nonionic, zwitterionic, or amphoteric polymer flocculants in the presence of microparticles for improving retention and drainage efficiency of papermaking furnishes.

BACKGROUND

The paper industry continuously strives to improve paper quality, increase process speeds, and reduce manufacturing costs. Manufacture of paper or paperboard involves producing an aqueous slurry of cellulosic wood fiber, which may also contain inorganic mineral extenders or pigments. The slurry is deposited on a moving wire or fabric whereupon the paper sheet is formed from the solid components by draining the water. This process is typically followed by pressing and drying sections. A variety of organic and inorganic chemicals are often added to the slurry before the sheet forming process to decrease costs, increase efficiency, and/or impart specific properties to the final paper product.

Typically, the limiting step in achieving faster process speeds in paper manufacturing is the dewatering or drainage of the fibrous slurry on the wire. Depending upon machine size and speed, this step removes large volumes of water in a very short period of time. The efficient removal of this water is critical in maintaining process speeds. Chemicals are sometimes added to the pulp before the wire to improve drainage and retention performance. These chemicals and chemical programs are often called retention and/or drainage aids. Retention aids are used to increase retention of fine furnish solids in the web during the turbulent process of draining and forming the paper web. Without adequate retention of these fine solids, they become lost in the process effluent or accumulate to excessively high concentrations in the recirculating white water loop leading to production difficulties. Insufficient retention of these fine solids and the disproportionate quantity of chemical additives which are adsorbed on their surfaces generally reduces paper quality characteristics, such as opacity, strength, and sizing.

Several forms of retention and drainage aids are known. For example, medium molecular weight diallyldimethylammonium chloride/acrylamide copolymers as retention and drainage aids are reviewed in Hunter et al., "*TAPPI 99 Preparing for the Next Millennium*," vol. 3, pp. 1345-1352, TAPPI Press (1999). U.S. Pat. No. 6,605,674 B1 discloses free radical polymerization of structurally modified cationic polymers and use of these polymers as retention and drainage aids in papermaking processes. U.S. Pat. No. 6,071,379 discloses the use of diallyl-N,N-disubstituted ammonium halide/acrylamide dispersion polymers as retention and drainage aids in papermaking processes. U.S. Pat. No. 5,254,221 discloses a method of increasing retention and drainage in a papermaking process using a low to medium molecular weight diallyldimethylammonium chloride/acrylamide copolymer in combination with a high molecular weight dialkylaminoalkyl(meth)acrylate quaternary ammonium salt/acrylamide copolymer.

U.S. Pat. No. 6,592,718 B1 discloses a method of improving retention and drainage in a papermaking furnish comprising adding to the furnish a diallyl-N,N-disubstituted ammonium halide/acrylamide copolymer and a high molecular weight structurally-modified, water-soluble cationic polymer. U.S. Pat. Nos. 5,167,776 and 5,274,055 disclose ionic, cross-linked polymeric microbeads having a diameter of less than about 1,000 nm and use of the microbeads in combination with a high molecular weight polymer or polysaccharide in a method of improving retention and drainage of a papermaking furnish.

Nonetheless, an ongoing need to develop new compositions and processes to further improve retention and drainage performance exists, particularly for use on faster and bigger modern papermaking machines currently being put into use. A particular need exists to improve retention and drainage in mechanical grade papermaking furnishes.

SUMMARY

This disclosure accordingly provides a novel method of improving retention and drainage in papermaking furnishes. Multi-component microparticle programs, such as those including colloidal silica or bentonite, are typically used in the paper industry. The described method outperforms such programs. An unexpected synergistic effect has been observed when certain amounts of a promoter are used in conjunction with a microparticle. Optionally, a flocculent is also used to further improve the observed synergism. The invention may be implemented with any type of papermaking furnish, including mechanical and chemical furnishes.

In an aspect, the invention includes a method of improving retention and drainage in a papermaking process. The method includes adding to a papermaking furnish an effective amount of a microparticle; an effective amount of a promoter, wherein the promoter includes a modified diallyl-N,N-disubstituted ammonium halide polymer; and optionally, an effective amount of a flocculent, wherein the flocculent includes one or more high molecular weight, water-soluble cationic, anionic, nonionic, zwitterionic, or amphoteric polymers having an RSV of at least about 3 dL/g.

In another aspect, the invention includes a method of activating a siliceous microparticle added to a papermaking furnish. The microparticle has a surface area of about 700 $m^2/g$ to about 1100 $m^2/g$ and an S-value from about 20 to about 50. The method includes adding an effective amount of a promoter and an effective amount of a flocculant to the papermaking furnish. The promoter includes a modified diallyl-N,N-disubstituted ammonium halide polymer having a cationic charge of about 1 to about 99 mole percent. The flocculant includes one or more high molecular weight, water-soluble cationic, anionic, nonionic, zwitterionic, or amphoteric polymers having an RSV of at least about 3 dL/g.

In a further aspect, the invention provides a composition for improving retention and drainage in a papermaking furnish. The composition includes a siliceous microparticle, a promoter, and an optional flocculant. The microparticle preferably has a surface area of about 700 $m^2/g$ to about 1100 $m^2/g$ and an S-value from about 20 to about 50. A preferred embodiment of the promoter includes a modified diallyl-N, N-disubstituted ammonium halide polymer having a cationic charge of about 1 to about 99 mole percent. The optional flocculant includes one or more high molecular weight, water-soluble cationic, anionic, nonionic, zwitterionic, or amphoteric polymers having an RSV of at least about 3 dL/g.

Additional features and advantages are described herein, and will be apparent from, the following Detailed Description and Examples.

DETAILED DESCRIPTION

"Papermaking process" means a method of making paper products from pulp. Such processes typically include forming an aqueous cellulosic papermaking furnish, draining the furnish to form a sheet, and drying the sheet. The steps of forming the papermaking furnish, draining, and drying may be carried out in any suitable manner generally known to those skilled in the art.

The microparticles of the invention may include any type of suitable microparticle. Preferred microparticles are similar to that described in U.S. Pat. No. 6,486,216 B1, incorporated herein by reference in its entirety. Such microparticles include colloidal silica in a stable aquasol. The microparticles typically have a surface area from about 700 $m^2$/gram to about 1100 $m^2$/gram, and an S-value from about 20 to about 50. The colloidal silica may or may not be surface treated and may include a molar ratio of $SiO_2$ to $Na_2O$, $K_2O$, or the like from about 13.0:1 to about 17.0:1. The $SiO_2$ solids level of the aquasol are generally from about 7 percent to about 16.80 percent. This type of microparticle is commercially available from Nalco Company® in Naperville, Ill.

In an embodiment, the microparticles include synthetic metal silicates, such as those described in U.S. Pat. App. No. 2007/0062659 A1, entitled "USE OF STARCH WITH SYNTHETIC METAL SILICATES FOR IMPROVING A PAPERMAKING PROCESS," incorporated herein by reference in its entirety. Such synthetic metal silicates are of the following formula: $(Mg_{3-x}\ Li_x)\ Si_4\ Na_{0.33}\ [F_y\ (OH)_{2-y}]_2\ O_{10}$; where x is 0 to 3.0 and y is 0.01 to 2.0. These silicates are typically made by combining simple silicates and lithium, magnesium, and/or fluoride salts in the presence of mineralizing agents and subjecting the resulting mixture to hydrothermal conditions. As an example, one might combine a silica sol gel with magnesium hydroxide and lithium fluoride in an aqueous solution and under reflux for two days to yield a preferred synthetic metal silicate. (See Industrial & Chemical Engineering Chemistry Research (1992), 31(7), 1654, which is herein incorporated by reference). The silicates are commercially available from Nalco Company®, Naperville, Ill. 60563.

In one embodiment, bentonite is used as the microparticle. "Bentonite" includes any of the materials commercially referred to as bentonites or as bentonite-type clays (i.e., anionic swelling clays such as sepialite, attapulgite, and montmorillonite). In addition, the bentonites described in U.S. Pat. No. 4,305,781 are suitable. A preferred bentonite is a hydrated suspension of powdered bentonite in water. Powdered bentonite is commercially available as Nalbrite®, from Nalco Company®.

In another embodiment, dispersed silicas may also be used. Representative dispersed silicas have an average particle size of from about 1 to about 100 nanometers (nm), preferably from about 2 to about 25 nm, and more preferably from about 2 to about 15 nm. This dispersed silica may be in the form of colloidal silicic acid, silica sols, fumed silica, agglomerated silicic acid, silica gels, precipitated silicas, and all materials described, for example, in U.S. Pat. No. 6,270,627 B1.

In alternative embodiments, the microparticle may include any suitable inorganic anionic or cationic microparticle. Representative examples are siliceous materials, such as synthetic silica-based particles, naturally occurring silica-based particles, silica microgels, colloidal silica, silica sols, silica gels, polysilicates, cationic silica, aluminosilicates, polyaluminosilicates, borosilicates, polyborosilicates, zeolites, swelling clays, the like, and combinations. This siliceous material may also be in the form of an anionic microparticulate material. If swelling clay is used as the microparticulate material, it is typically a bentonite-type clay. Preferred clays are swellable in water and include clays which are naturally water-swellable or modifiable clays, such as by ion exchange to render them water-swellable. Exemplary water-swellable clays include but are not limited to hectorite, smectites, montmorillonites, nontronites, saponite, sauconite, hormites, attapulgites, and sepiolites.

Preferably, the microparticle is added to the papermaking furnish in an amount from about 0.001 to about 10 kg/tonne. More preferably, the dosage is from about 0.01 to about 5 kg/tonne. Most preferably, the microparticle is added from about 0.1 to about 2 kg/tonne, based in dry furnish.

In a preferred embodiment, the promoter of the invention is a modified diallyl-N,N-disubstituted ammonium halide polymer. That is, a polymer of one or more diallyl-N,N-disubstituted ammonium halide monomers and one or more acrylamide monomers. An example of making such polymers is described in U.S. Pat. App. Nos. 2006/0084772 A1 and 2006/0084771 A1, both entitled, "METHOD OF PREPARING DIALLYL-N,N-DISUBSTITUTED AMMONIUM HALIDE POLYMERS" (each incorporated by reference in their entirety, the text of which is partially reproduced herein). It should be appreciated, however, that any suitable method could be used to produce the polymers of the invention.

For the preferred polymers, "diallyl-N,N-disubstituted ammonium halide monomer" typically means a monomer of formula $[(H_2C{=}CHCH_2)_2N^+R_4R_5X^-]$. $R_4$ and $R_5$ are independently $C_1$ to $C_{20}$ alkyl, aryl, or arylalkyl and X is an anionic counterion. Representative anionic counterions include halogen, sulfate, nitrate, phosphate, and the like. A preferred anionic counterion is halogen. A preferred diallyl-N,N-disubstituted ammonium halide monomer is diallyldimethylammonium chloride.

In an embodiment, the polymer is cross-linked. In this embodiment, the number average particle size diameter is at least about 1,000 nm. In another embodiment, the polymer is not cross-linked. Non-cross linked polymers typically have a number average particle size diameter of at least about 100 nm. Representative preferred modified diallyl-N,N-disubstituted ammonium halide polymers include inverse emulsion polymers, dispersion polymers, solution polymers, and gel polymers.

"RSV" stands for reduced specific viscosity. Within a series of polymer homologs which are substantially linear and well solvated, "reduced specific viscosity (RSV)" measurements for dilute polymer solutions are an indication of polymer chain length and average molecular weight according to Paul J. Flory, in "*Principles of Polymer Chemistry*", Cornell University Press, Ithaca, N.Y., © 1953, Chapter VII, "*Determination of Molecular Weights*", pp. 266-316. The RSV is measured at a given polymer concentration and temperature and calculated as follows:

$$RSV = \frac{[(\eta/\eta_o) - 1]}{c}$$

$\eta$=viscosity of polymer solution $\eta_o$=viscosity of solvent at the same temperature c=concentration of polymer in solution.

The units of concentration "c" are (grams/100 ml or grams/deciliter). Therefore, the units of RSV are dL/g. In this patent application, a 1.0 molar sodium nitrate solution is used for measuring RSV, unless specified. The polymer concentration in this solvent is 0.045 g/dL. The RSV is measured at 30° C. The viscosities $\eta$ and $\eta_o$ are measured using a Cannon Ubbelohde semimicro dilution viscometer, size 75. The viscometer is mounted in a perfectly vertical position in a constant temperature bath adjusted to 30±0.02° C. The typical error inherent in the calculation of RSV for the polymers described herein is about 0.2 dL/g. When two polymer homologs within a series have similar RSVs that is an indication that they have similar molecular weights.

"IV" stands for intrinsic viscosity, which is RSV extrapolated to the limit of infinite dilution, infinite dilution being when the concentration of polymer is equal to zero.

"Inverse emulsion polymer" means a water-in-oil polymer emulsion comprising a cationic, anionic, amphoteric, zwitterionic, or nonionic polymer according to this invention in an aqueous phase, a hydrocarbon oil for an oil phase and a water-in-oil emulsifying agent. Inverse emulsion polymers are hydrocarbon continuous with the water-soluble polymers dispersed within the hydrocarbon matrix. The inverse emulsion polymers are then "inverted" or activated for use by releasing the polymer from the particles using shear, dilution, and, generally, another surfactant. See U.S. Pat. No. 3,734,873, incorporated herein by reference. Representative preparations of high molecular weight inverse emulsion polymers are described in U.S. Pat. Nos. 2,982,749; 3,284,393; and 3,734,873. See also, Hunkeler, et al., "*Mechanism, Kinetics and Modeling of the Inverse-Microsuspension Homopolymerization of Acrylamide," Polymer*, vol. 30(1), pp 127-42 (1989); and Hunkeler et al., "*Mechanism, Kinetics and Modeling of Inverse-Microsuspension Polymerization: 2. Copolymerization of Acrylamide with Quaternary Ammonium Cationic Monomers," Polymer*, vol. 32(14), pp 2626-40 (1991).

The aqueous phase is prepared by mixing in water one or more water-soluble monomers, and any polymerization additives such as inorganic salts, chelants, pH buffers, and the like. The oil phase is prepared by mixing together an inert hydrocarbon liquid with one or more oil soluble surfactants. The surfactant mixture should have a hydrophilic-lypophilic balance (HLB) that ensures the formation of a stable oil continuous emulsion. Appropriate surfactants for water-in-oil emulsion polymerizations, which are commercially available, are compiled in the North American Edition of McCutcheon's *Emulsifiers & Detergents*. The oil phase may need to be heated to ensure the formation of a homogeneous oil solution and is then charged into a reactor equipped with a mixer, a thermocouple, a nitrogen purge tube, and a condenser. The aqueous phase is added to the reactor containing the oil phase with vigorous stirring to form an emulsion. The resulting emulsion is heated to the desired temperature, purged with nitrogen, and a free-radical initiator is added. The reaction mixture is stirred for several hours under a nitrogen atmosphere at the desired temperature. Upon completion of the reaction, the water-in-oil emulsion polymer is cooled to room temperature, where any desired post-polymerization additives, such as antioxidants, or a high HLB surfactant (as described in U.S. Pat. No. 3,734,873) may be added.

The resulting inverse emulsion polymer is a free-flowing liquid. An aqueous solution of the water-in-oil emulsion polymer can be generated by adding a desired amount of the inverse emulsion polymer to water with vigorous mixing in the presence of a high-HLB surfactant (as described in U.S. Pat. No. 3,734,873).

"Dispersion polymer" means a dispersion of fine particles of polymer in an aqueous salt solution, which is prepared by polymerizing monomers with stirring in an aqueous salt solution in which the resulting polymer is insoluble. See U.S. Pat. Nos. 5,708,071; 4,929,655; 5,006,590; 5,597,859; 5,597,858; and EP Pat. Nos. 657,478 and 630,909.

In a typical procedure for preparing a dispersion polymer, an aqueous solution containing one or more inorganic or hydrophobic salts, one or more water-soluble monomers, any polymerization additives such as processing aids, chelants, pH buffers, and a water-soluble stabilizer polymer is charged to a reactor equipped with a mixer, a thermocouple, a nitrogen purging tube, and a water condenser. The monomer solution is mixed vigorously, heated to the desired temperature, and then an initiator is added. The solution is purged with nitrogen while maintaining temperature and mixing for several hours. After this time, the mixture is cooled to room temperature, and any post-polymerization additives are charged to the reactor. Water continuous dispersions of water-soluble polymers are free flowing liquids with product viscosities generally 100-10,000 cP, measured at low shear.

In a typical procedure for preparing solution and gel polymers, an aqueous solution containing one or more water-soluble monomers and any additional polymerization additives such as chelants, pH buffers, and the like is prepared. This mixture is charged to a reactor equipped with a mixer, a thermocouple, a nitrogen purging tube, and a water condenser. The solution is mixed vigorously, heated to the desired temperature, and then one or more polymerization initiators are added. The solution is purged with nitrogen while maintaining temperature and mixing for several hours. Typically, the viscosity of the solution increases during this period. After the polymerization is complete, the reactor contents are cooled to room temperature and then transferred to storage. Solution and gel polymer viscosities vary widely, and are dependent upon the concentration and molecular weight of the active polymer component. The solution/gel polymer can be dried to give a powder.

In a preferred aspect of this invention, the modified diallyl-N,N-disubstituted ammonium halide polymer has a RSV of from about 0.2 to about 12 dL/g or from about 1 to about 10 dL/g and a charge density of less than about 7 meq/g polymer.

In another preferred aspect, the diallyl-N,N-disubstituted ammonium halide polymer has a cationic charge density of about 1 to about 99 mole percent or from about 20 to about 80 mole percent.

In another preferred aspect, the modified diallyl-N,N-disubstituted ammonium halide polymer includes about 30 to about 70 mole percent diallyldimethylammonium chloride monomer and about 70 to about 30 mole percent acrylamide monomer, has a charge density of less than about 6 meq/g polymer, and an RSV of less than about 8 dL/g.

In an embodiment, the microparticle and the modified diallyl-N,N-disubstituted ammonium halide polymer are used in combination with an effective amount of one or more cationic, anionic, nonionic, zwitterionic, or amphoteric polymer flocculants in order to increase retention and drainage in a papermaking furnish.

Suitable flocculants generally have molecular weights in excess of 1,000,000 and often in excess of 5,000,000. The polymeric flocculent is typically prepared by vinyl addition polymerization of one or more cationic, anionic, or nonionic monomers; by copolymerization of one or more cationic monomers with one or more nonionic monomers; by copolymerization of one or more anionic monomers with one or more nonionic monomers; by copolymerization of one or more cationic monomers with one or more anionic monomers and optionally one or more nonionic monomers to produce an amphoteric polymer; or by polymerization of one or more zwitterionic monomers and optionally one or more nonionic monomers to form a zwitterionic polymer. One or more zwitterionic monomers and optionally one or more nonionic monomers may also be copolymerized with one or more anionic or cationic monomers to impart cationic or anionic charge to the zwitterionic polymer.

While cationic polymer flocculants may be formed using cationic monomers, it is also possible to react certain nonionic vinyl addition polymers to produce cationically charged polymers. Polymers of this type include those prepared through the reaction of polyacrylamide with dimethylamine and formaldehyde to produce a Mannich derivative. Similarly, while anionic polymer flocculants may be formed using anionic monomers, it is also possible to modify certain nonionic vinyl addition polymers to form anionically charged polymers. Polymers of this type include, for example, those prepared by the hydrolysis of polyacrylamide.

The flocculant may be used in solid form, as an aqueous solution, as a water-in-oil emulsion, or as dispersion in water. Representative cationic polymers include copolymers and terpolymers of (meth)acrylamide with dimethylaminoethyl methacrylate (DMAEM); dimethylaminoethyl acrylate (DMAEA); diethylaminoethyl acrylate (DEAEA); diethylaminoethyl methacrylate (DEAEM); or their quaternary ammonium forms made with dimethyl sulfate, methyl chloride, or benzyl chloride. In alternative embodiments, the flocculant includes dimethylaminoethylacrylate methyl chloride quaternary salt-acrylamide copolymers and sodium acrylate-acrylamide copolymers and hydrolyzed polyacrylamide polymers.

In a preferred aspect of this invention, the flocculants have a RSV of at least about 3 dL/g, at least about 10 dL/g, or at least about 15 dL/g. In an embodiment, the flocculant includes dimethylaminoethylacrylate methyl chloride quaternary salt-acrylamide copolymers and/or sodium acrylate-acrylamide copolymers and hydrolyzed polyacrylamide polymers.

The effective amount of the promoter and the polymer flocculant depend on the characteristics of the particular papermaking furnish and can be readily determined by one of ordinary skill in the papermaking art. In an embodiment, the promoter is dosed in a synergistically effective amount. Typical dosages of the promoter is from about 0.01 to about 10, preferably from about 0.05 to about 5 and more preferably from about 0.1 to about 1 kg polymer actives/tonne solids in the furnish.

Likewise, the effective amount of the flocculant also depends on the characteristics of the particular papermaking furnish and can be readily determined by one of ordinary skill in the papermaking art. In an embodiment, the effective amount of flocculant added is a synergistically effective amount. Typical dosages of the polymer flocculant are from about 0.005 to about 10, preferably from about 0.01 to about 5, and more preferably from about 0.05 to about 1 kg polymer actives/tonne solids in the furnish.

It should be appreciated that each of the described components may be added to the papermaking furnish in any suitable order and at any suitable stage. The order and method of addition of the microparticle, the promoter, and the polymer flocculent are not critical and can be readily determined by one of ordinary skill in the papermaking art. Each component can be added to the papermaking system in any form, such as neat, powder, slurry, or solution. The preferred primary solvent for the components is water, but is not limited to such and any suitable solvent may be used. Moreover, the components of the invention may be compatible with other pulp and papermaking additives, such as starches, fillers, titanium dioxide, defoamers, wet strength resins, and sizing aids.

The components of the invention may be added to the papermaking system in a simultaneous or sequential manner. They may be added in a pre-mixed fashion or as separate components; and may be added directly to the pulp furnish or indirectly, for example, through the headbox. The microparticle may be dosed before, simultaneously, or after the promoter and/or flocculant. For instance, in a forward addition sequence the promoter and optional flocculant are added prior to a shear stage (e.g., pumping, mixing, cleaning, or screening stage) and the microparticle is added after the shear stage. In a reverse addition sequence, the microparticle is added prior to the shear stage and the promoter and optional flocculant are added after the shear stage. Such sequences are further illustrated in the Examples below.

The following are preferred, representative methods of addition. In one preferred method of addition, the flocculent and the promoter are dosed separately, for example, to the thin stock and/or the headbox. In another preferred method of addition, the flocculant and the promoter are dosed separately to the thin stock with the flocculent added first followed by the promoter. In another preferred method of addition, the promoter is added to tray water (e.g., the suction side of the fan pump prior to thick stock addition) and the flocculant to the thin stock line. In a further preferred method of addition, the promoter is added to the dilution head box stream and the flocculant is added to the thin stock line. In an additional preferred method of addition, the promoter is added to thick stock (e.g., stuff box, machine chest, or blend chest) followed by addition of the flocculant in the thin stock line.

EXAMPLES

The foregoing may be better understood by reference to the following examples, which are intended for illustrative purposes and are not intended to limit the scope of the invention.

In the examples below, the following compositions were used. It should be appreciated that each composition may alternatively include a pure solution of the described component or a heterogeneous solution having one or a variety of other components. The flocculant was an aqueous cationic polymer solution of acrylamide-dimethylaminoethyl acrylate methyl chloride quat copolymer (CAS Reg. No. 69418-26-4; available from Nalco Company® in Naperville, Ill.). The promoter was an aqueous cationic polymer solution of acrylamide-diallyl-dimethyl-ammonium chloride copolymer (CAS Reg. No. 26590-05-6; available from Nalco Company®). The microparticle was an aqueous solution of colloidal silica (CAS Reg. No. 7631-86-9; available from Nalco Company). Percol® 47 was a commercial (available from Ciba Specialty Chemicals). For all examples, composition dose was based on 1,000 kg (i.e., 1 tonne) dry furnish.

Example 1

Gravity drainage tests were carried out using a Dynamic Filtration System model no. DFS-03, manufactured by Mutek (BTG, Herrching, Germany). During drainage measurement, the stirring compartment was filled with 1-liter of newsprint stock and subjected to a shear of approximately 1,000 rpm during addition of the various compositions, as described in Table 1. The stock was drained through a 25-mesh screen for 60 seconds and the filtrate mass (in grams) was determined after the drainage period. Table 2 shows the gravity drainage results for a variety of microparticle programs in newsprint furnish.

TABLE 1

| DFS-03 Drainage Test Conditions | |
|---|---|
| Mixing Speed | 1,000 rpm |
| Screen | 25-mesh |
| Shear Time | 30 sec |
| Sample Size | 1,000 ml |
| Drain Time | 60 sec |
| **Dosing Sequence** | |
| t = 0 sec | Start |
| t = 10 sec | Coagulant |
| t = 15 sec | Microparticle or Promoter (Reverse addition) |
| t = 20 sec | Flocculant or Flocculant/Promoter (premix) |
| t = 25 sec | Microparticle or Promoter (Forward addition) |
| t = 30 sec | Drain |
| t = 60 sec | Stop |

TABLE 2

| Composition Dose (kg/tonne) | Addition method | Filtrate mass (g) |
|---|---|---|
| Flocculant (0.75) Promoter (1.0) | Separate | 240.2 |
| Percol ® 47 (0.25) Bentonite (2.0) | Separate | 247.2 |
| Flocculant (0.75) Microparticle (2.0) | Forward addition | 235.2 |
| Microparticle (2.0) Flocculant (0.75) | Reverse addition | 212.5 |
| [Flocculant (0.75) and Promoter (1.0) pre-mix] Microparticle (2.0) | Forward addition | 306.6 |
| Microparticle (2.0) [Flocculant (0.75) and Promoter (1.0) pre-mix] | Reverse addition | 257.2 |

Example 2

The drainage conditions for the LWC (light weight coated) stock were slightly modified from those for newsprint furnish, as shown in Table 3. Filtrate mass results for various microparticle programs are shown in Tables 4A and 4B.

TABLE 3

| DFS-03 Drainage Test Conditions | |
|---|---|
| Mixing Speed | 800 rpm |
| Screen | 25-mesh |
| Shear Time | 30 sec |
| Sample Size | 1,000 ml |
| Drain Time | 90 sec |
| **Dosing Sequence** | |
| t = 0 sec | Start |
| t = 10 sec | Coagulant |
| t = 15 sec | Microparticle or Promoter (Reverse addition) |
| t = 20 sec | Flocculant or Flocculant/Promoter (premix) |

TABLE 3-continued

| | |
|---|---|
| t = 25 sec | Microparticle or Promoter (Forward addition) |
| t = 30 sec | Drain |
| t = 120 sec | Stop |

TABLE 4A

| Composition Dose (kg/tonne) | Addition Method | Filtrate Mass (g) |
|---|---|---|
| Flocculant (0.5) | Separate | 345.5 |
| Flocculant (0.5) Promoter (1.0) | Pre-mix | 359.9 |
| Flocculant (0.5) Microparticle (5.0) | Forward addition | 400.4 |
| [Flocculant (0.5) and Promoter (1.0) pre-mix] Microparticle (5.0) | Forward addition | 465.6 |
| Flocculant (0.5) Bentonite (2.0) | Forward addition | 426.4 |

TABLE 4B

| Composition Dose (kg/tonne) | Addition Method | Filtrate Mass (g) |
|---|---|---|
| Flocculant (0.5) | Separate | 334.6 |
| Flocculant (0.5) Promoter (1.0) | Pre-mix | 351.0 |
| Microparticle (2.0) Flocculant (0.5) | Reverse addition | 336.4 |
| Microparticle (2.0) [Flocculant (0.5) and Promoter (1.0) pre-mix] | Reverse addition | 370.8 |
| [Flocculant (0.5) and Promoter (1.0) pre-mix] Microparticle (2.0) | Forward addition | 383.9 |

Example 4

A retention performance comparison was conducted using a Dynamic Drainage Jar (DDJ), also referred to as a "Britt Jar" according to the procedure described in TAPPI Test Method T261 cm-94, incorporated herein by reference. The results are expressed as First Pass Retention (FPR) and First Pass Ash Retention (FPAR). Increased retention of filler and fines is indicated by higher FPR and FPAR values. Table 5 explains the test conditions and Table 6 shows results for various microparticle programs in LWS furnish.

TABLE 5

| Dynamic Drainage Jar Test Conditions | |
|---|---|
| Mixing Speed | 1000 rpm |
| Screen | 125-P |
| Sample Size | 500 ml |
| **Dosing Sequence** | |
| t = 0 sec | Start |
| t = 10 sec | Coagulant |
| t = 15 sec | Microparticle or Promoter (Reverse addition) |
| t = 20 sec | Flocculant or Flocculant/Promoter (premix) |
| t = 25 sec | Microparticle or Promoter (Forward addition) |
| t = 30 sec | Open drain valve and collect filtrate |
| t = 60 sec | Stop collecting filtrate |

TABLE 6

| Composition Dose (kg/tonne) | Addition Method | % FPR | % FPAR |
|---|---|---|---|
| Flocculant (0.75) Promoter (1.0) | Pre-mix | 77.6 | 63.5 |
| Percol ® 47 (0.25) Bentonite (2.0) | Separate | 72.68 | 52.5 |
| Flocculant (0.75) Microparticle (2.0) | Forward addition | 77.05 | 59.2 |
| Microparticle (2.0) Flocculant (0.75) | Reverse addition | 74.34 | 58.7 |
| [Flocculant (0.75) and Promoter (1.0) pre-mix] Microparticle (2.0) | Forward addition | 81.81 | 70.9 |
| Microparticle (2.0) [Flocculant (0.75) and Promoter (1.0) pre-mix] | Reverse addition | 79.11 | 62.5 |

It should be understood that various changes and modifications to the described invention can be made without departing from the spirit and scope of the invention and without diminishing its intended advantages. It is therefore intended that such changes and modifications be covered by the appended claims.

The claimed invention is:

1. A method of improving retention and drainage in a papermaking process, the method comprising adding to a papermaking furnish, in any order: (a) an effective amount of a microparticle; (b) an effective amount of a promoter, wherein the promoter includes a modified diallyl-N,N-disubstituted ammonium halide polymer which is composed of more than 30 mole % and less than 70 mole % diallyldimethylammonium chloride monomer and between less than 70 mole % and more than 30 mole % acrylamide monomer, the modified diallyl-N,N-disubstituted ammonium halide polymer has an RSV of between 0.2 and 12 dL/g and a charge density of less than 7 miliequivalents/g polymer, and (c) an effective amount of a flocculent, wherein the flocculent includes one or more high molecular weight, water-soluble cationic, anionic, nonionic, zwitterionic, or amphoteric polymers having an RSV of at least about 3 dL/g wherein the combination of all three of (a), (b), and (c) increase the retention properties of a papermaking furnish beyond the performance of ionic, cross-linked polymeric microbeads having a diameter of less than about 1000 nm combined with a high molecular weight polysaccharide in the furnish, and wherein the modified diallyl-N,N-disubstituted ammonium halide polymer has a cationic charge of about 1 to about 99 mole percent and was prepared according to the steps of:

(i) preparing an aqueous solution comprising one or more diallyl-N,N-disubstituted ammonium halide monomers and about 35 to about 85 percent of the total acrylamide monomer;

(ii) initiating polymerization of the monomers;

(iii) allowing the polymerization to proceed to at least about 5 percent diallyl-N,N-disubstituted ammonium halide monomer conversion and at least about 20 percent acrylamide monomer conversion; and (iv) adding the remaining acrylamide monomer and allowing the polymerization to proceed to the desired endpoint.

2. The method of claim 1, wherein the microparticle is a colloidal silica material.

3. The method of claim 1, wherein the microparticle is one item selected from the list consisting of bentonite, colloidal silica, and colloidal borosilicate.

4. The method of claim 1, including adding from about 1 to about 8 lb/tonne of the microparticle, based on dry furnish.

5. The method of claim 1, including adding a synergistically effective amount of the promoter to the papermaking furnish.

6. The method of claim 1, including adding from about 0.01 to about 10 kg/tonne of the promoter to the papermaking furnish, based on dry furnish.

7. The method of claim 1, wherein the modified diallyl-N, N-disubstituted ammonium halide polymer has a cationic charge of about 1 to about 99 mole percent.

8. The method of claim 1, wherein the modified diallyl-N, N-disubstituted ammonium halide polymer has an RSV from about 0.2 dL/g to about 12 dL/g and a charge density of less than about 7 meq/g polymer.

9. The method of claim 1, wherein the modified diallyl-N, N-disubstituted ammonium halide polymer is selected from the group consisting of: inverse emulsion polymers, dispersion polymers, solution polymers, gel polymers, and combinations thereof.

10. The method of claim 1, wherein the modified diallyl-N,N-disubstituted ammonium halide polymer has a charge density of less than about 7 meq/g polymer and an RSV of less than about 10 dL/g.

11. The method of claim 1, including adding a synergistically effective amount of the flocculant to the papermaking furnish.

12. The method of claim 1, including adding from about 0.005 to about 10 kg/tonne of the flocculent to the papermaking furnish, based on dry furnish.

13. The method of claim 1, wherein the flocculant is selected from the group consisting of: dimethylaminoethylacrylate methyl chloride quaternary salt-acrylamide copolymers; sodium acrylate-acrylamide copolymers; hydrolyzed polyacrylamide polymers; and combinations thereof.

14. The method of claim 1, including adding the microparticle at a point selected from the group consisting of: before a shear stage; after a shear stage; before the promoter; after the promoter; before the flocculant; after the flocculent; simultaneously with the promoter; simultaneously with the flocculant; pre-mixed with the promoter; pre-mixed with the flocculant; and pre-mixed with the promoter and the flocculant.

15. The method of claim 1, wherein the addition of the microparticle and the promoter increases the opacity of the resulting paper by increasing the retention of fine furnish solids.

16. The method of claim 1, including adding the promoter or the flocculent after a shear stage or before a shear stage.

17. The method of claim 1, including adding the microparticle, the promoter, and/or the flocculent at any stage of the papermaking process, wherein each component is added either at a same stage or a different stage.

18. The method of claim 17, wherein said stage is selected from the group consisting of: tray water, dilution head box stream, thin stock, thick stock, and thin stock line.

19. The method of claim 1, wherein the promoter is a modified diallyl-N,N-disubstituted ammonium halide polymer having a cationic charge of about 20 to about 80 mole percent prepared by polymerizing one or more acrylamide monomers and one or more diallyl-N,N-disubstituted ammonium halide monomers in the presence of about 0.1 to less than about 3,000 ppm, based on monomer, of one or more chain transfer agents and 1 to 1,000 ppm, based on monomer, of one or more cross-linking agents.

* * * * *